US005660478A

United States Patent [19]

Alack et al.

[11] Patent Number: 5,660,478

[45] Date of Patent: Aug. 26, 1997

[54] CONTAINER FOR HOLDING FLUENT MATERIAL

[75] Inventors: Charles S. Alack, St. Louis; Avrom R. Handleman, Webster Groves; Benjamin Allan Wanner, Hillsboro, all of Mo.

[73] Assignee: Semi-Bulk Systems, Inc., Fenton, Mo.

[21] Appl. No.: 523,260

[22] Filed: Sep. 5, 1995

[51] Int. Cl.[6] ..... B65D 30/16; B65D 33/02

[52] U.S. Cl. ..... 383/119; 206/597; 383/121.1

[58] Field of Search ..... 206/597; 383/19, 383/119, 121.1

[56] References Cited

U.S. PATENT DOCUMENTS

| | | | |
|---|---|---|---|
| 310,210 | 1/1885 | Liedel . | |
| 2,297,835 | 10/1942 | Levengood | 15/56 |
| 2,637,477 | 5/1953 | Tucker | 226/59 |
| 2,656,958 | 10/1953 | Austin | 224/5 |
| 2,751,953 | 6/1956 | Grimm | 150/0.5 |
| 2,815,784 | 12/1957 | Cunningham | 150/0.5 |
| 2,913,029 | 11/1959 | Paton | 150/1 |
| 2,954,203 | 9/1960 | Carter | 249/64 |
| 3,044,515 | 7/1962 | Eades | 150/1 |
| 3,253,751 | 5/1966 | Paton | 222/195 |
| 3,774,812 | 11/1973 | Lemelson | 383/19 |
| 3,776,453 | 12/1973 | Smith | 222/566 |
| 3,777,775 | 12/1973 | Handleman | 137/268 |
| 3,818,550 | 6/1974 | Cresswell | 24/243 |
| 3,980,196 | 9/1976 | Paulyson et al. | 220/1.5 |
| 4,007,694 | 2/1977 | Fowler et al. | 108/55 |
| 4,054,161 | 10/1977 | Alack | 141/12 |
| 4,079,907 | 3/1978 | Mykleby | 248/119 |
| 4,149,755 | 4/1979 | Handleman et al. | 302/53 |
| 4,182,386 | 1/1980 | Alack | 141/83 |
| 4,194,312 | 3/1980 | Connors et al. | 38/102 |
| 4,205,930 | 6/1980 | Handleman et al. | 406/90 |
| 4,467,504 | 8/1984 | Quist | 24/462 |
| 4,591,075 | 5/1986 | Eriksson | 222/195 |
| 4,662,038 | 5/1987 | Walker | 24/460 |
| 4,842,228 | 6/1989 | Kasper | 248/97 |
| 4,966,310 | 10/1990 | Hawkins | 383/19 |
| 5,025,925 | 6/1991 | Wiklund | 206/597 |
| 5,073,035 | 12/1991 | Williams | 383/19 |
| 5,316,387 | 5/1994 | Polett et al. | 383/119 |
| 5,497,897 | 3/1996 | Alack et al. | 220/320 |

OTHER PUBLICATIONS

Semi-Bulk SystemS, Inc., "Bulk Powder Handling The cleaner, faster, easier way—the Air-Pallet® System with Reusable, Fluidized Bed Container," dated 1986.

Semi-Bulk SystemS, Inc., "One Filling Machine Now Handles Both Air-Pallet® Container, Bulk Bag," dated 1986.

*Primary Examiner*—Stephen P. Garbe

*Attorney, Agent, or Firm*—Senniger, Powers, Leavitt & Roedel

[57] ABSTRACT

A container for holding fluent material comprises a bag of flexible material defining a volume for containing a load of material, a rigid base for supporting the bag, and tension members within the bag for constraining the bag to assume a shape in which the bag is generally rectangular in horizontal cross section when a load is contained within the volume. The bag has four side walls, a top opening in communication with the volume for loading of fluent material into the container, and a bottom. The tension members include a first elongate flexible tension member extending across the interior of the bag between a first side wall and a second side wall of the bag, and a second elongate flexible tension member extending across the interior of the bag between a third side wall and a fourth side wall of the bag. The respective ends of respective tension members are connected to respective side walls of the bag for constraining outward bulging of the side walls when a load is contained within the volume so that the bag assumes a generally rectangular horizontal cross section. The elongate tensions members of the set are so positioned and so dimensioned in transverse cross section that they do not significantly inhibit free flow of the fluent material within the volume in any direction.

20 Claims, 7 Drawing Sheets

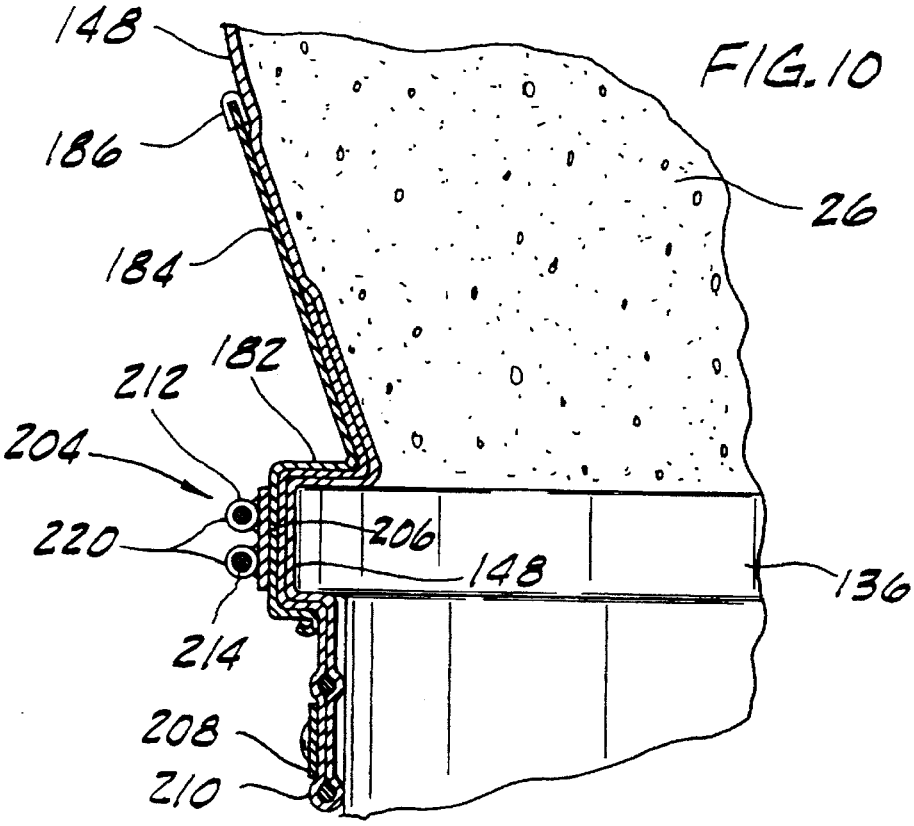
FIG. 10
FIG. 12
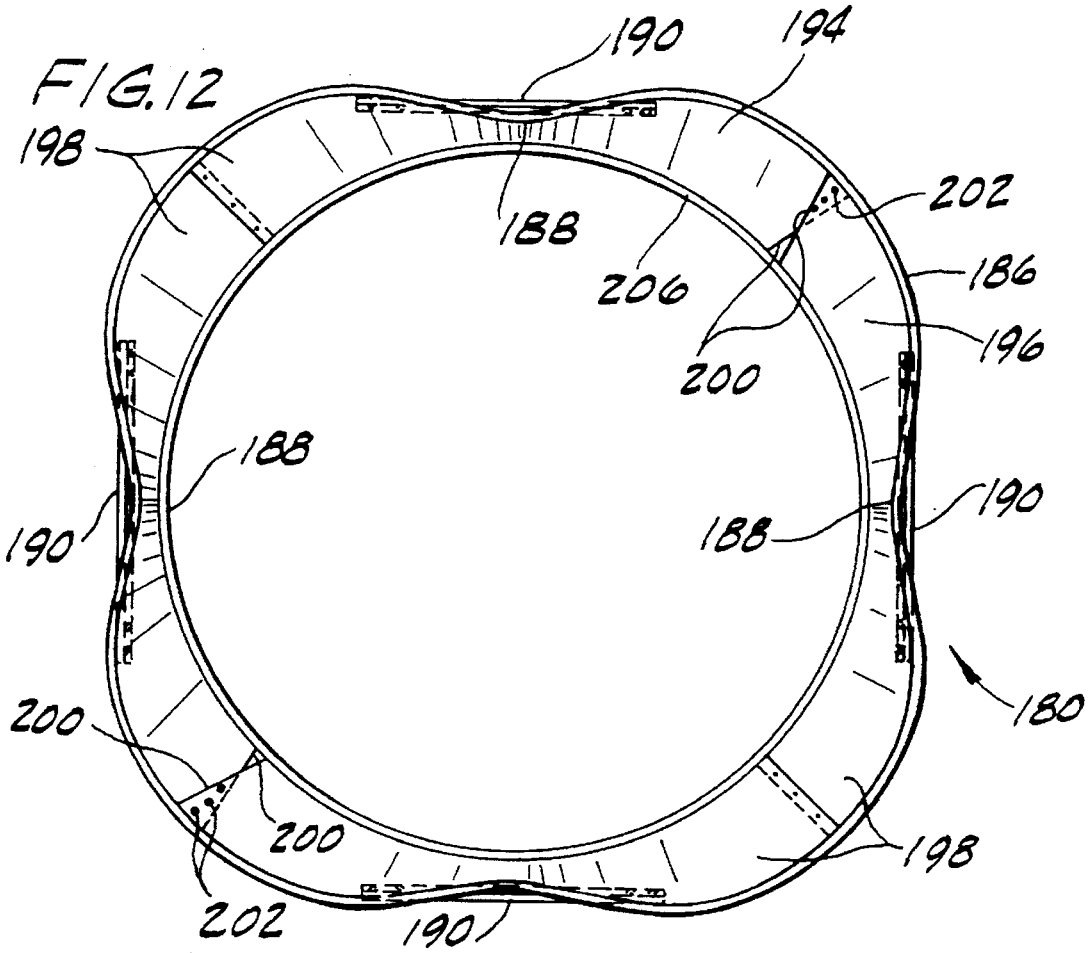

CONTAINER FOR HOLDING FLUENT MATERIAL

BACKGROUND OF THE INVENTION

This invention relates generally to material handling apparatus and more particularly to a container for holding a load of fluent material, such as a fine granular, particulate, or powdered material.

The container of this invention represents an improvement over the container disclosed in co-assigned U.S. Pat. No. 4,159,755 and commercially available from the assignee of this invention, Semi-Bulk Systems, Inc. of St. Louis, Mo. under registered trademark AIR PALLET. The latter container has a generally circular pallet base which supports a generally cylindric bag of flexible material for containing a load of powder or other fluent material. While this container has proven to be generally satisfactory, the cylindric shape of the bag is not the most space efficient for packing or grouping a number of containers closely together in side-by-side relation (a substantial amount of space is wasted between the bags because of their cylindric shape). This results in higher storage and transportation costs. Moreover, bags of cylindric shape are somewhat unstable and have a tendency to tilt on their base, especially if the material in the bag is relatively loosely packed.

BAG Corporation has developed a container system which includes a bag having vertical walls or baffles on the inside of the bag extending from substantially the bottom to the top of the bag. These interior walls hold the bag in a non-cylindric shape (generally rectangular) which is inherently more space efficient. The walls have holes which permit limited flow of material through the walls. Nevertheless, the walls substantially impede lateral (side-to-side) flow of material within the container, making side discharge unloading of the bag impractical. Furthermore, the interior walls are secured to the bag by stitching. The holes formed by this stitching permit undesirable leakage into and/or from the bag.

SUMMARY OF THE INVENTION

Among the several objects and features of the present invention may be noted the provision of an improved container which is more space efficient for packing or grouping a number of containers closely together in side-by-side relation; the provision of such a container which increases the stability of the container when supporting and storing a load of fluent material; the provision of such container which retains the desired shape of the container without significantly inhibiting the free flow of the fluent material within the container; the provision of such a container which is constructed to provide a vapor barrier; and the provision of the bag which reduces transportation and storage costs.

Generally, an improved container of this invention comprises a bag of flexible material defining a volume for containing a load of fluent material. The bag has four side walls, a top opening in communication with the volume for loading of fluent material into the container to fill the volume, and a bottom. The container further comprises a rigid base for supporting the bag and constraining means within the bag for constraining the bag to assume a shape in which the bag is generally rectangular in horizontal cross section when a load is contained within the volume. The constraining means comprises at least one set of tension members within the bag, including a first elongate flexible tension member extending across the interior of the bag between a first side wall and a second side wall of the four side walls of the bag, and a second elongate flexible tension member extending across the interior of the bag between a third side wall and a fourth side wall of the four side walls of the bag. Respective ends of respective tension members are connected to respective side walls of the bag for constraining outward bulging of the side walls when a load is contained within the volume so that the bag assumes a generally rectangular horizontal cross section when a load is contained within the volume.

The elongate tension members of the set of tension members are so positioned relative to one another and so dimensioned in transverse cross section that they do not significantly inhibit free flow of the fluent material within the volume in any direction with respect to the bag. The flexibility of the tension members permits the bag to collapse when a load is not contained within the volume.

Other objects and features will be in part apparent and in part pointed out hereinafter.

BRIEF DESCRIPTION OF THE DRAWINGS

FIG. 10 is an enlarged side elevational view of a collar secured to a base of the container;

FIG. 12 is a top plan view of the collar shown in FIG. 10.

Corresponding reference characters indicate corresponding parts throughout the several views of the drawings.

DETAILED DESCRIPTION OF THE PREFERRED EMBODIMENT

Figure 1:
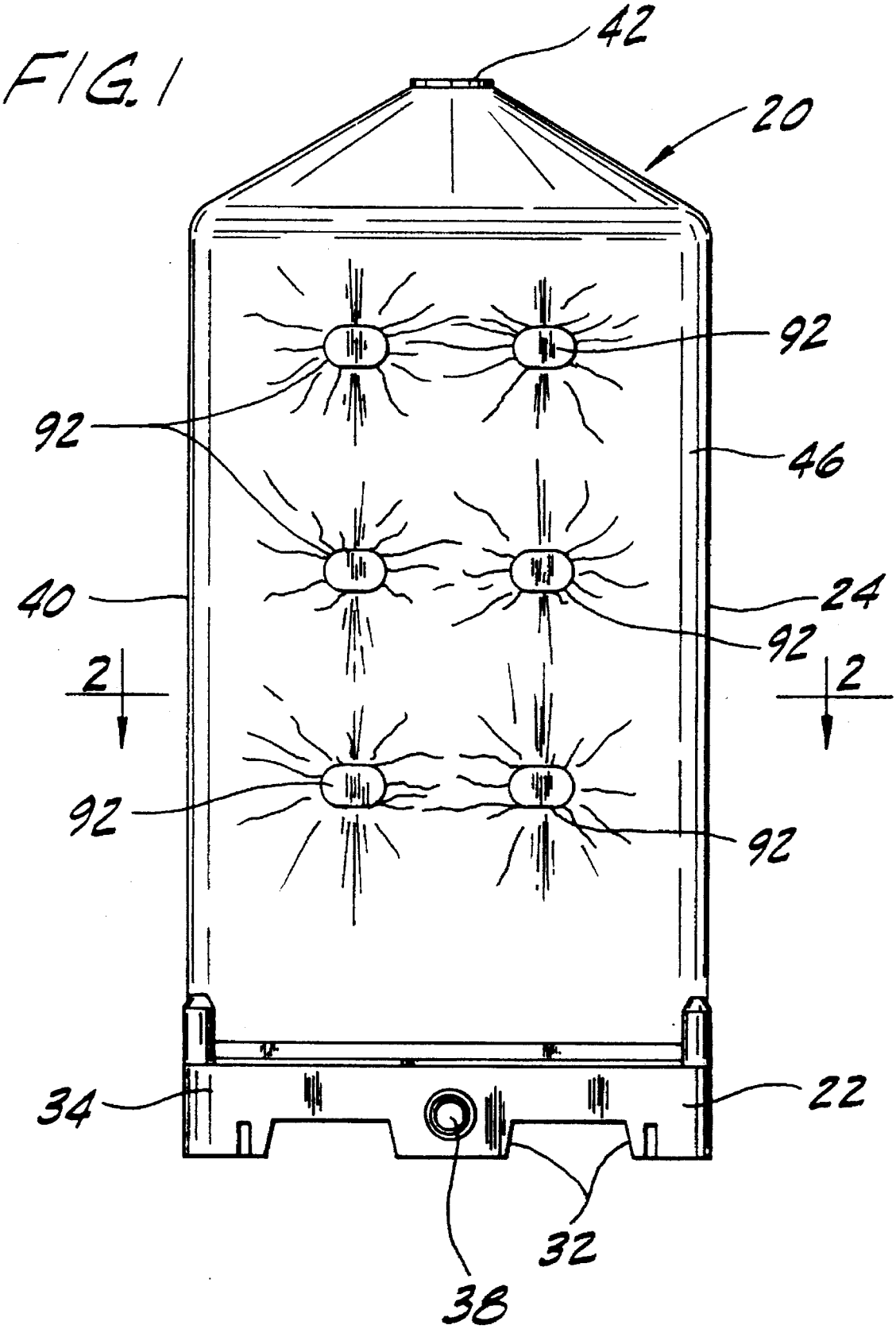
FIG. 1 is a side elevational view of a container of this invention.

Referring now to the drawings, a container for transporting and storing a load of fine granular, particulate, powdered or other conditionable (fluidizable) material is indicated generally at 20 (FIG. 1). The container 20 is shown to comprise a rigid base 22, a bag 24 of flexible material secured to the base and defining a volume for containing a load 26 of fluent material, and constraining means generally indicated at 28 within the bag for constraining the bag to assume a shape in which the bag is generally rectangular in horizontal cross section when a load is contained within the volume.

The base 22 is a generally rectangular, one-piece pallet preferably molded of a suitable synthetic resin material (e.g., polyethylene or nylon). The pallet has a plurality of legs 32 engageable with the ground for supporting the container 20 and the load 26 therewithin. The legs 32 are spaced apart to receive lifting tines of a forklift (not shown) so that the loaded container may be readily transported. As disclosed in co-assigned pending U.S. patent application Ser. No. 08/222,083, which is incorporated herein by reference, the pallet base 22 includes an outer, generally vertical peripheral wall 34 defining the outside of the pallet, a generally planar load supporting deck (not shown) inclined downwardly toward one side of the pallet base, and a gas-permeable membrane (not shown) overlying the deck. The base 22 has a gas inlet (not shown) at one side of the base for the introduction of pressurized gas into the base and an outlet opening 38 for the discharge of conditioned (fluidized) material within the container. Reference may be made to pending U.S. patent application Ser. No. 08/222,083 for further details regarding the construction of the base.

The bag 24 of the container 20 has four side walls, generally indicated at 40, a top opening 42 in communication with the volume for loading of fluent material 26 into the bag to fill the volume, and an open bottom 44. The bag 24 is preferably formed of a flexible, gas-impervious, heat sealable sheet material, such as a plastic coated fabric of the type commercially available from Van Leer Plastics, Inc. of Houston, Tex. under the trademark VALERON. The bag 24 may be of multi-part construction. For example, the relatively large main body portion 46 of the bag 24 (which is constrained to have a generally rectangular shape when filled) may be a sleeve formed from four panels of the aforementioned sheet material having vertical edges heat sealed together in overlapping relation. The height of the bag 24 is preferably (but not necessarily) no greater than twice the diameter so as to maintain the stability of the bag. The bottom 44 of the bag 24 is open and overlies the gas-permeable membrane of the base 22. Gas introduced through the gas inlet flows up through the membrane of the base 22 and into the volume defined by the bag 24 via the open bottom 44 of the bag 24 to condition the material 26 within the container 20 for unloading.

Figure 2:
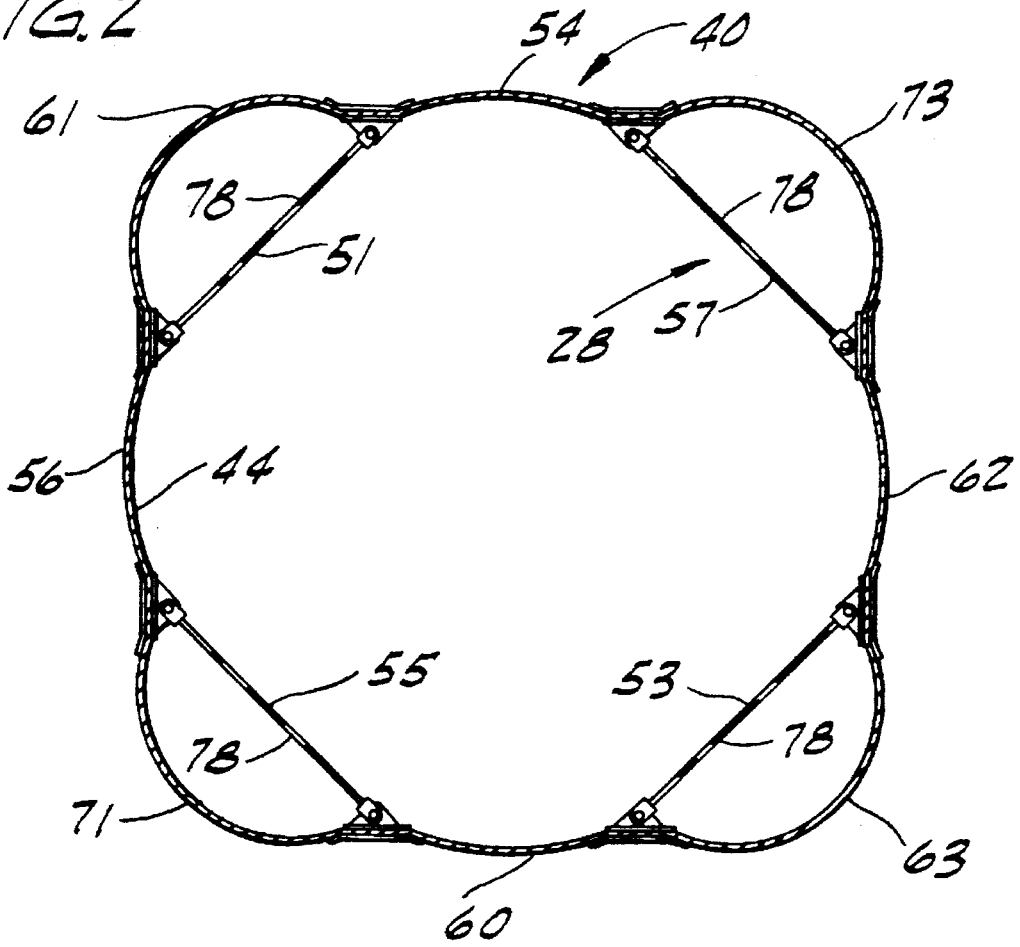
FIG. 2 is a horizontal section taken along line 2—2 of FIG. 1 illustrating constraining means within a bag of the container.

As noted, when filled with a load of fluent material 26 the bag 24 is configured by constraining means 28 to a shape in which the bag is generally rectangular in horizontal cross section. The constraining means 28 comprises at least one set of tension members within the bag 24. As depicted in the drawings, the bag 24 has three such sets of tension members, each set being disposed generally at the same level and being vertically spaced from each other set inside the main body portion 46 of the bag. As shown in FIG. 2, each set of tension members includes four tension members depicted 51, 53, 55, and 57. The first tension member 51 extends between two adjacent side walls 54, 56 of the bag, and the second tension member 53 extends generally parallel to the first tension member between two adjacent side walls 60, 62 of the bag. The first and second tension members 51, 53 are located generally adjacent a first pair of diagonally opposite corners of the bag indicated at 61 and 63, respectively. The third tension member 55 extends between two adjacent side walls 56, 60 of the bag, and the fourth tension member 57 extends generally parallel to the third tension member between two adjacent side walls 54, 62 of the bag. The third and fourth tension members are located generally adjacent a second pair of diagonally opposite corners of the bag indicated at 71 and 73, respectively.

As shown in FIG. 2, each tension member is in the form of a flexible wire cable 89 which may be covered with a flexible sheath 79 to protect the cable. The cable may be formed, for example, from 3/32 in. galvanized or stainless steel braided wire strands, and the sheath may be fabricated from 1/8 in. plastic tubing. Other materials are also suitable. It is important, however, that the sheathed cable have an overall diameter which is sufficiently small so that it does not significantly inhibit free flow of the fluent material within the volume in any direction with respect to the bag 24. The flexibility of the cables and sheaths allows the bag to collapse when the bag is not full of material.

Figure 4:
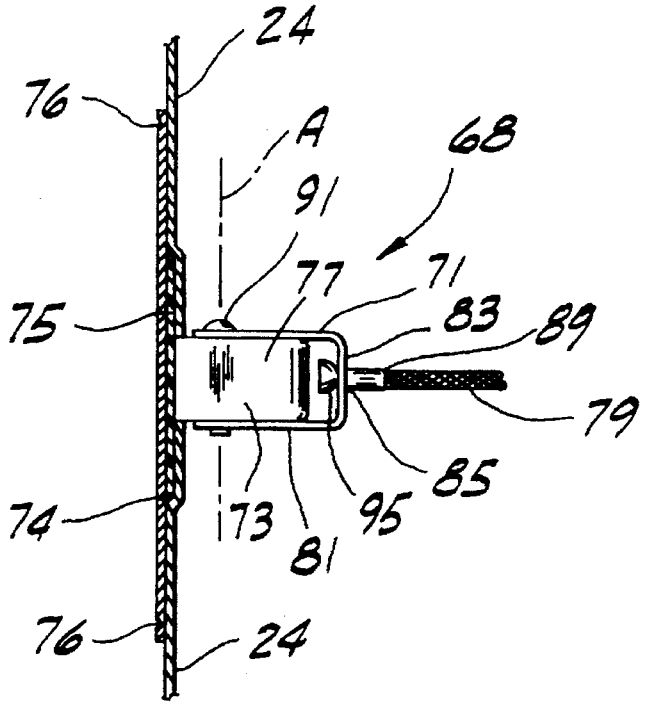
FIG. 4 is a partial vertical section taken along line 4—4 of FIG. 3 illustrating a tension member connected at one end to a connector secured to a respective side wall of the bag.

The tension members are connected at their ends to side walls of the bag by connectors, each generally designated at 68. Each connector comprises a coupling 73 and a clevis 71 attached to the coupling. The coupling has a base 75 and a body 77 extending from the base. The body 77 has a vertical hole (not shown) through it. The clevis 71 is generally U-shaped, having two legs 81 and a head 83 connecting the two legs. A pin or rivet 91 extends through the two legs 81 and through the hole in the body of the coupling 73 so that the clevis 71 can pivot relative to the connector about a generally vertical axis A (FIG. 4). The pivoting of the clevis 71 relative to the coupling 73 allows the tension members to align themselves relative to one another such that the bag 24 retains its rectangular shape. One end of a respective tension member extends through a hole 85 in the head 83 of the clevis 71 and is retained in position by a retaining member 95 secured (e.g., swaged) on the end of the cable 89. It will be understood that the tension members 51, 53, 55, 57 may be secured to the connectors 68 by any means of attachment and still be within the scope of this invention.

Figure 3:
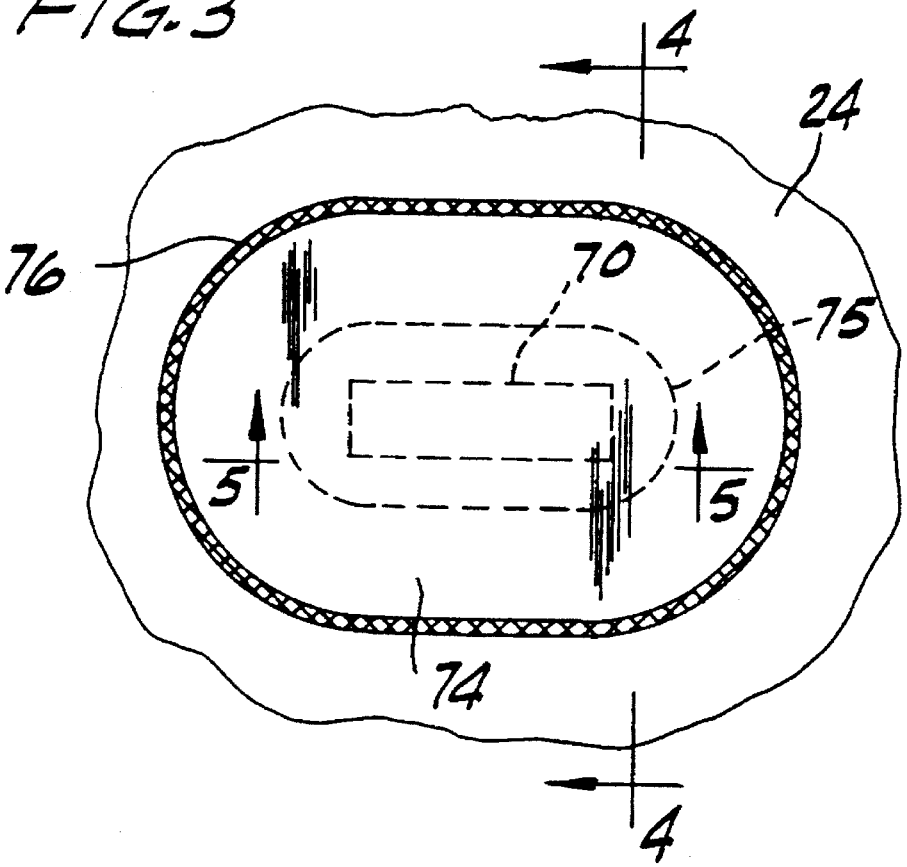
FIG. 3 is an enlarged side elevational view of a cover sheet sealed to the outside of the bag in a position overlying a coupling of this invention.
Figure 5:
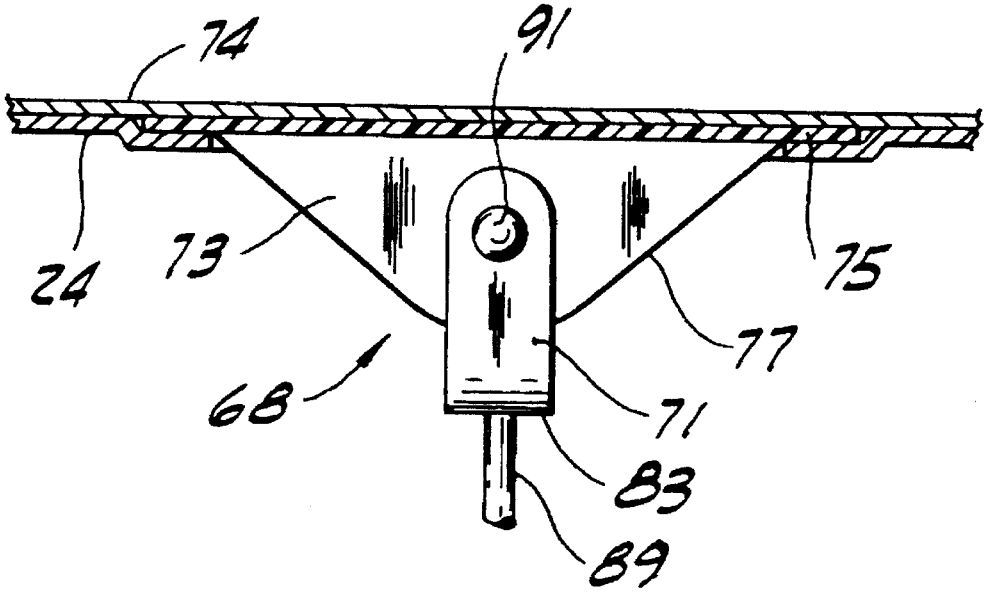
FIG. 5 is a partial horizontal section taken along line 5—5 of FIG. 3 illustrating a connector secured to a respective side wall of the bag.
Figure 6:
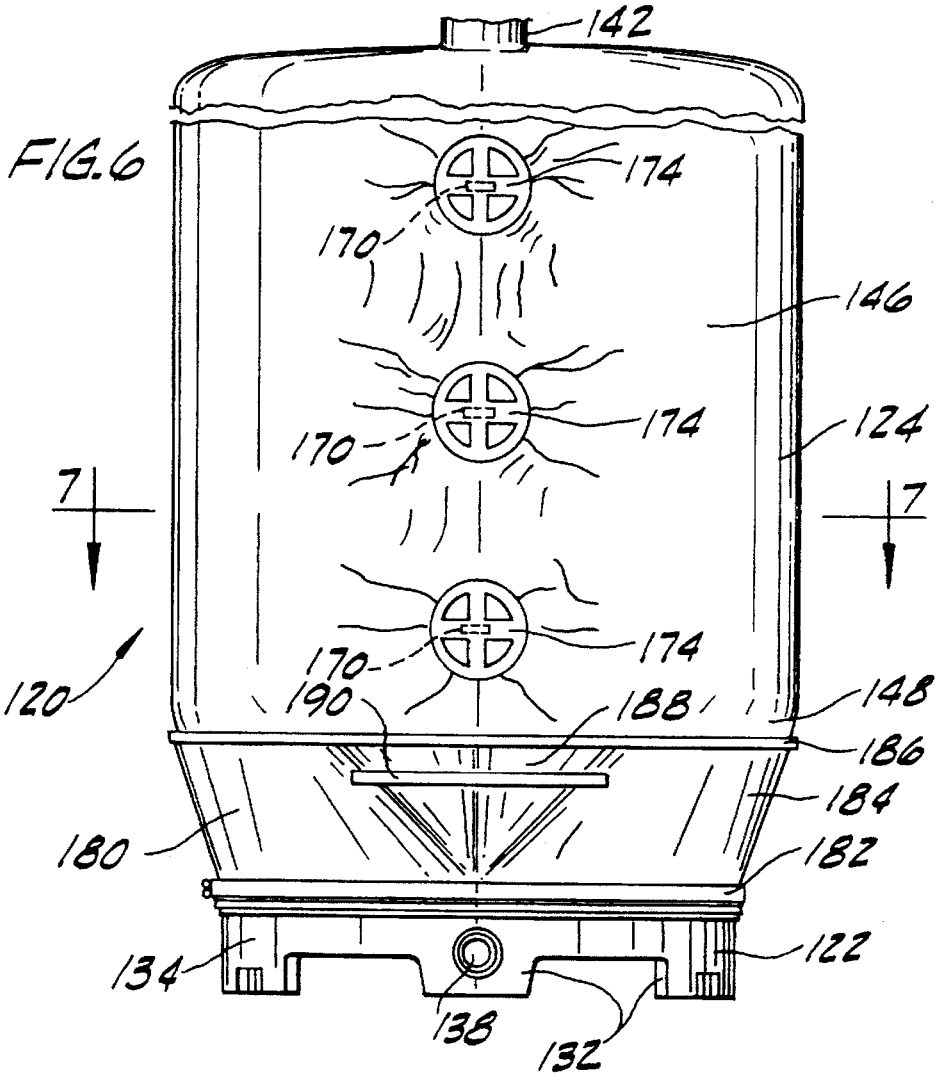
FIG. 6 is a partial side elevational view of a second embodiment of a container of this invention.

As shown in FIGS. 3, 4 and 5, the base 75 of each coupling 73 is positioned on the outside of a respective side wall of the bag, and the body 77 of the coupling extends through a generally horizontal slit 70 in the side wall. The slit is preferably horizontal to reduce the risk of "running"—uncontrolled tearing—of the slit, which is more common with a vertical slit. A cover sheet 74 overlies the base 75 of the coupling. The cover sheet 74 is heat sealed to the bag along seal lines indicated at 76, to secure the cover sheet on the outside of the bag with the cover sheet overlying the base 75 of the coupling 73 to seal the opening 70 in the side wall through which the coupling extends. Heat sealing is the preferred method of sealing the slit 70 because, unlike the stitching holes inherent with sewing, it maintains the integrity of the vapor barrier of the bag 24. The cover sheet 74 further serves to reinforce the bag. It will be understood that the connectors 68 can be secured to the bag by alternative means without departing from the scope of this invention.

FIGS. 6 through 12 illustrate a second embodiment of this invention. Parts of the second embodiment which correspond to the same or similar parts in the first embodiment are indicated by the same reference numeral with the addition of a prefix "1". In this embodiment, the elongate tension members of each set comprise two relatively narrow flexible strap-like web members 152, 158 (FIG. 7), each of which is so dimensioned in transverse cross section that it does not significantly inhibit the free-flow of material within the bag. In the configuration shown in FIG. 7, the first elongate flexible tension member 152 extends across the interior of the bag 124 between a first side wall 154 and a second side wall 156 of the four side walls of the bag, and the second elongate flexible tension member 158 extending across the interior of the bag between a third side wall 160 and a fourth side wall 162 of the four side walls of the bag. Respective ends 164 of respective tension members 152, 158 are connected to respective side walls 154, 156, 160, 162 of the bag 124 for constraining outward bulging of the side walls so that the bag (at least the main body portion 146 thereof) assumes a generally rectangular (e.g., square) horizontal cross section when a load 26 is contained within the volume. The tension members 150 are flexible which allows the bag 124 to collapse when a load 26 is not contained within the volume. It will be understood that the tension members 152, 158 do not necessarily have to cross or can cross at different locations and still be within the scope of the present invention.

Figure 7:
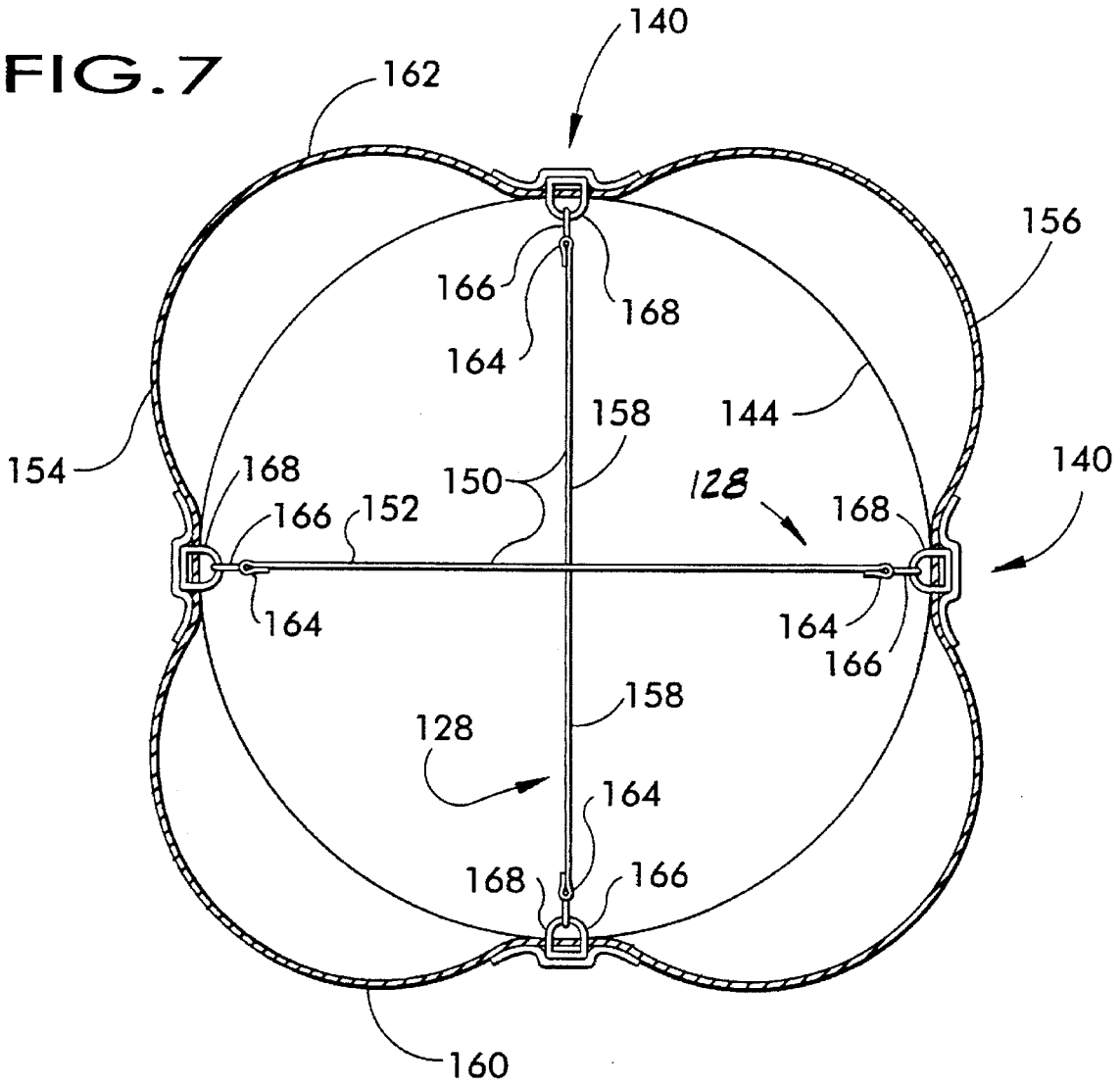
FIG. 7 is a horizontal section taken along line 7—7 of FIG. 6 illustrating constraining means within a bag of the container.
Figure 8:
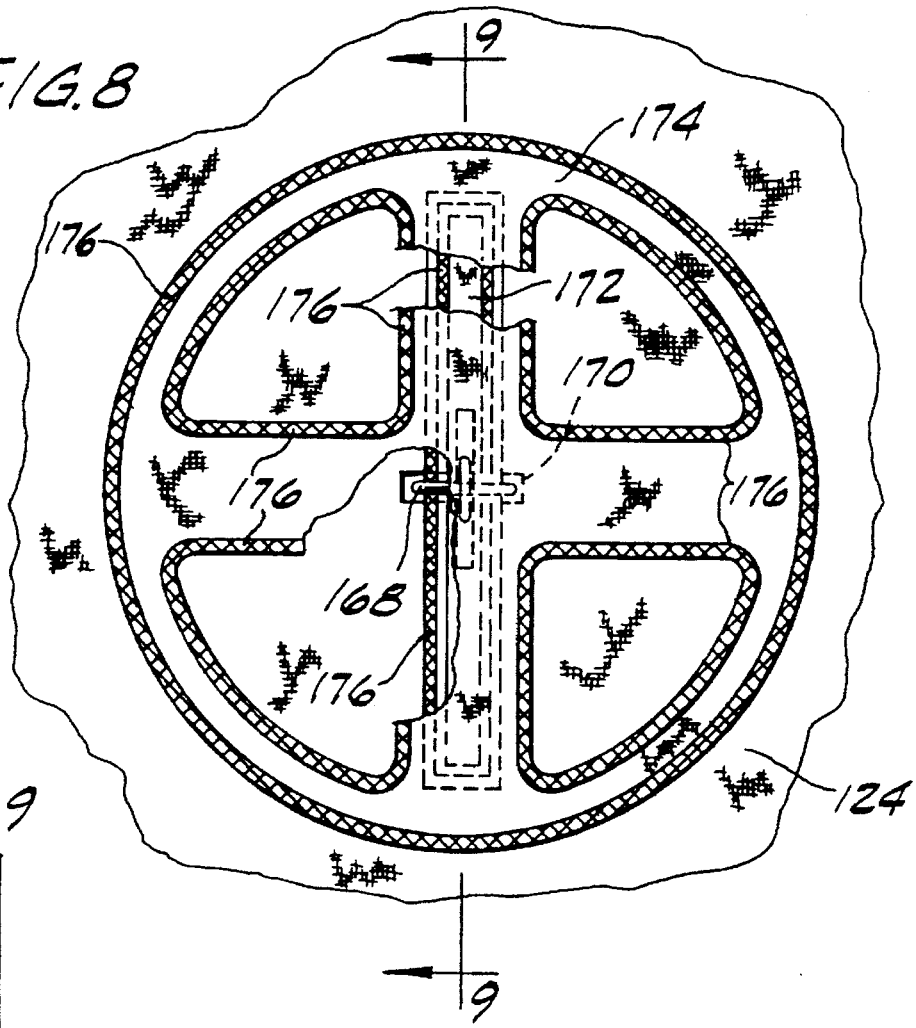
FIG. 8 is an enlarged side elevational view of a cover sheet sealed to the outside of the bag in a position overlying a ring and a strap of this invention.
Figure 9:
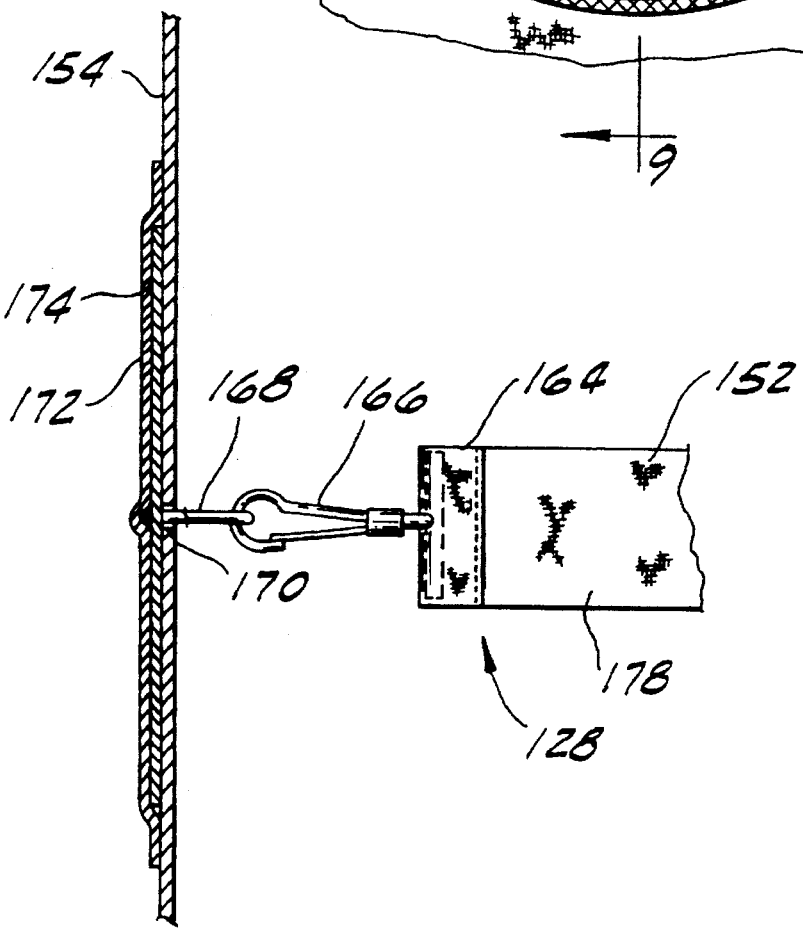
FIG. 9 is a partial vertical section taken along line 9—9 of FIG. 8 illustrating a tension member releasably connected at one end to a ring secured to a respective side wall of the bag.

The ends 164 of the first and second tension members 152, 158 of each set 150 are releasably connected by means of clips 166 to rings 168 (e.g., D-rings) secured to respective side walls 154, 156, 160, 162 of the bag 124 (see FIGS. 7 and 9). The rings 168 extend from outside of the bag 124 to inside of the bag through generally horizontal slits 170 in respective side walls 154, 156, 160, 162 of the bag. Each ring 168 is secured to the side wall 140 by a strap 172 which extends through the ring on the outside of the bag 124. A cover sheet 174 overlies the ring and the strap. The strap 172 and cover sheet 174 are heat sealed to the bag 124 along seal lines indicated at 176, to secure the strap and cover sheet on the outside of the bag with the cover sheet overlying the ring 168 to seal the opening 170 in the side wall 140 through which the ring extends.

The container 120 of the second embodiment, further comprises a rigid collar 180 extending up from the base 122 and surrounding the bag 124 at its tapered lower end 148 for supporting the bag against tilting relative to the base. The collar 180 has a circular lower end 182 which is secured to the base 122. A conical wall 184 extends up from the circular lower end 182 and surrounds the tapered lower end 148 of the bag 124. The conical wall 184 has an upper rim 186 with a generally rectangular configuration generally corresponding to the generally rectangular (e.g., square) cross sectional shape of the main body portion 146 of the bag 124. The conical wall 184 and rim 186 of the collar 180 are formed with large, inwardly extending corrugations or indentations 188 at locations in general vertical alignment with the locations at which the tension members 152, 158 are secured to the side walls 140 of the bag 124. It will be understood that such indentations 188 can be at locations other than in vertical alignment with the locations at which the tension members 152, 158 are secured and still be within the scope of the present invention. As shown in FIG. 12, the collar 180 further includes collar reinforcing bars 190 which extend across the indentations 188 to retain the rectangular configuration of the upper rim 186.

The collar 180 is preferably a split metal collar adapted for releasable attachment to the base 122. The split metal collar 180 comprises two collar halves 194, 196 each of which may be formed from two separate panels, each indicated at 198, secured together, as by welding. The collar halves 194, 196 are releasably fastened at adjoining side edges 200 by rivets indicated at 202 and a pair of adjustable screw connectors 204 adjacent the lower ends 182 of the collar halves. The bottom edge margins of the collar halves 194, 196 are bent to form an annular rim 206 which fits closely around the circular flange 136 of the pallet base 122, the arrangement being such that when one or both of the connectors 204 are tightened, the collar 180 is clamped against the pallet base and thus secured thereto. As shown in FIG. 10, the lower end 148 of the bag 124 extends down on the outside of the base 122 between the rim 206 of the collar 180 and the flange 136 of the base 122. It will be apparent, therefore, that when the connectors 204 of the collar 180 are tightened, the rim 206 of the collar clamps the bag 124 against the base 122. A metal band 208 immediately below the collar 180 also surrounds the bag 124 and clamps it to the base 122. The band 208 is suitably affixed to the base 122 (as by screws). The bottom edge 148 of the bag 124 is formed with a hem 210 having two cords (not shown) therein which prevents the bag from being pulled up past the band 208. The clamping of the bag 124 against the base 122 by the rim 206 of the collar 180 and by the band 208 holds the bag securely on the base during conditioning (fluidization) of the load 26 and provides a seal against the leakage of gas and product from within the bag.

Figure 11:
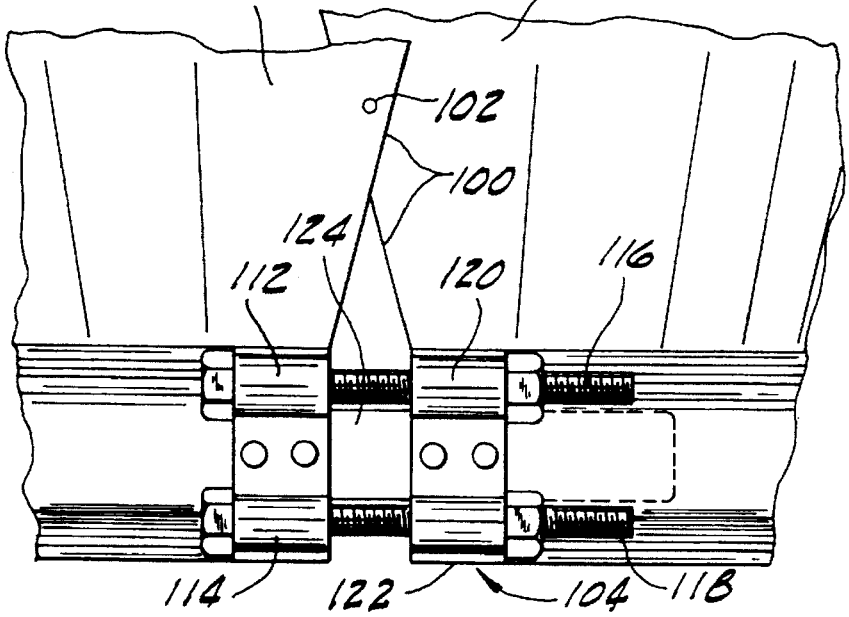
FIG. 11 is an enlarged side elevational view of a screw connector securing the collar to the base of the container.

As shown in FIG. 11 and as disclosed in co-assigned U.S. Pat. No. 4,149,755, each screw connector 204 comprises a first pair of upper and lower tubular barrels 212, 214 and a second pair of upper and lower barrels 220, 222 for receiving upper and lower bolts 216, 218. One pair of upper and lower barrels 212, 214 is secured to the lower end 182 of one collar half 194 and likewise, the other set of upper and lower barrels 220, 222 is secured to the lower end 182 of the other collar half 196. By tightening the bolts 216, 218, the collar 180 may be tightened a desired amount within the limits of the bolts. The screw connector 204 further includes a resilient tongue 224 of relatively thin gauge stainless steel or the like which is secured to one collar half 194 and extends under an edge of the other collar half 196 to protect the bag 124 from damage—such as being torn—when the connector is tightened. While the connector 204 has been described as a bolt tightening arrangement, other type of tensioning devices, such as overcenter buckles and the like may be used.

To use a container 120 of this invention, a bag 124 and collar 180 are secured to the base 122. A load of fluent material 26 is then introduced into the bag 124 via the top opening 142 of the bag to fill the volume. The tension members 152, 158 within the bag 124 constrain the bag so that when it is filled it assumes a shape in which the main body portion 146 of the bag is generally rectangular in horizontal cross section, as shown in FIG. 7. The rigid collar 180 surrounding the tapered lower end 148 of the bag 124 stabilizes the bag and prevents it from tipping during handling, transportation and storage of the container 120. The generally rectangular configuration of the bag 124 also permits the containers 120 to be packed closely together in side-by-side relation without the wasted space inherent when packing cylindrically shaped containers next to one another.

To unload material 26 from the container 120, gas is introduced in the gas inlet and flows up through the membrane of the base 122 into the volume defined by the bag 124 to condition the product therewithin. During this process, the rigid collar 180 and metal band 208 securely hold the bag 124 in place on the pallet base 122 and in sealing relation therewith. Fluidized product 26 from within the bag 124 is discharged from the container 120 via outlet 138. As disclosed in the above-mentioned U.S. Pat. No. 4,149,755, a discharge conduit or hose (not shown) is removably inserted into the discharge opening of the pallet 122 so that product 26 discharged therefrom can be conveyed to a desired location. The process described also applies to the container 120 having a rectangular base.

It will be understood that a variety of different films and bag configurations may be used in a container 20, 120 of this invention depending on the quantity of product 26 to be contained in the bag 24, 124 the characteristics (i.e., density, toxicity, etc.) of the product, the number of desired reuses of the container, and other parameters. It will also be understood that the number of sets of tension members (51, 53, 55, 57) or (152, 158) and their configuration within the bag may vary depending on the size of the bag 24 or 124 and other considerations. In any event, the position and dimension of the tension members should be such that they constrain the shape of the bag so that it assumes a generally rectangular shape in horizontal cross when filled without significantly inhibiting the free flow of fluent material 26 in any direction within the bag 24, 124.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A container for holding fluent material comprising a bag of flexible material defining a volume for containing a load of said material, said bag having four side walls, a top opening in communication with said volume for loading of fluent material into the container to fill said volume, and a bottom, a rigid base for supporting said bag, constraining means within the bag for constraining the bag to assume a shape in which the bag is generally rectangular in horizontal cross section when a load is contained within said volume, said constraining means comprising at least one set of tension members within the bag, said set comprising a first elongate flexible tension member extending across the interior of the bag between a first side wall and a second side wall of the four side walls of the bag, and a second elongate flexible tension member extending across the interior of the bag between a third side wall and a fourth side wall of the four side walls of the bag, respective ends of respective tension members being attached to connectors secured to respective side walls of the bag for constraining outward bulging of the side walls when a load is contained within said volume so that the bag assumes a generally rectangular horizontal cross section when a load is contained within said volume, each connector extending from the outside of the bag to the inside of the bag through an opening in the side wall of the bag, and cover sheets sealed to the bag on the outside of the bag in a position overlying each connector to seal the opening in the side wall through which each connector extends, the elongate tensions members of said set being so positioned relative to one another and so dimensioned in transverse cross section that they do not significantly inhibit free flow of said fluent material within said volume in any direction with respect to the bag, and the flexibility of the tension members permitting collapse of the bag when a load is not contained within said volume.

2. A container as set forth in claim 1 wherein the tension members of said set extend generally at right angles to one another.

3. A container as set forth in claim 2 wherein the tension members of said set cross one another generally on the central vertical axis of said volume.

4. A container as set forth in claim 1 wherein said first tension member extends between two adjacent side walls of the bag, and wherein said second tension member extends generally parallel to the first tension member between two adjacent side walls of the bag, said first and second tension members being located generally adjacent a first pair of diagonally opposite corners of the bag.

5. A container as set forth in claim 4 wherein said set of tension members further comprises a third tension member extending between two adjacent side walls of the bag, and a fourth tension member extending generally parallel to the third tension member between two adjacent side walls of the bag, said third and fourth tension members being located generally adjacent a second pair of diagonally opposite corners of the bag.

6. A container as set forth in claim 1 comprising a plurality of sets of said tension members, each set being vertically spaced from each other set inside the bag.

7. A container as set forth in claim 1 wherein said opening in said side wall of the bag is a generally horizontal slit.

8. A container as set forth in claim 1 wherein said cover sheet is heat sealed to the bag.

9. A container as set forth in claim 8 wherein the bag is constructed of a fabric coated with a heat sealable synthetic resin material, and wherein said cover sheet is secured to the bag by heat seals.

10. A container as set forth in claim 9 wherein said connector comprises a coupling secured to the side wall of the bag and a clevis attached to the coupling and the tension member.

11. A container as set forth in claim 10 wherein said coupling comprises a base disposed on the outside of the bag and a body extending from the base to the inside of the bag through the opening, said body having a hole therein.

12. A container as set forth in claim 11 wherein said connector further comprises a pin extending through the clevis and hole in the body of the coupling so that the clevis can pivot relative to the connector about a generally vertical axis.

13. A container as set forth in claim 8 wherein each connector is secured to the side wall by a strap which extends through the connector on the outside of the bag and which is affixed to the bag, said strap being heat sealed to the bag.

14. A container as set forth in claim 1 wherein said first and second tension members comprise two relatively narrow web members.

15. A container as set forth in claim 1 wherein said first and second tension members comprise two cables.

16. A container as set forth in claim 15 wherein said tension members further comprise a sheath covering each cable.

17. A container for holding fluent material comprising a bag of flexible material defining a volume for containing a load of said material, said bag having four side walls, a top opening in communication with said volume for loading of fluent material into the container to fill said volume, and a bottom, a rigid base for supporting said bag, said base being generally circular in shape and the bag, when filled with a load of said material, having a lower end which tapers downwardly toward the base to provide a transition from said generally rectangular cross sectional shape of the bag to the generally circular shape of the base, and constraining means within the bag for constraining the bag to assume a shape in which the bag is generally rectangular in horizontal cross section when a load is contained within said volume, said constraining means comprising at least one set of tension members within the bag, said set comprising a first elongate flexible tension member extending across the interior of the bag between a first side wall and a second side wall of the four side walls of the bag, and a second elongate flexible tension member extending across the interior of the bag between a third side wall and a fourth side wall of the four side walls of the bag, respective ends of respective tension members being connected to respective side walls of the bag for constraining outward bulging of the side walls when a load is contained within said volume so that the bag assumes a generally rectangular horizontal cross section when a load is contained within said volume, the elongate tensions members of said set being so positioned relative to one another and so dimensioned in transverse cross section that they do not significantly inhibit free flow of said fluent material within said volume in any direction with respect to the bag, and the flexibility of the tension members permitting collapse of the bag when a load is not contained within said volume.

18. A container as set forth in claim 17 further comprising a rigid collar extending up from the base and surrounding the bag at its tapered lower end for supporting the bag against tilting relative to the base.

19. A container as set forth in claim 18 wherein said collar has a circular lower end secured to the base and a conical wall extending up from the base and surrounding the tapered lower end of the bag, said conical wall having an upper rim with a generally rectangular configuration generally corresponding to said generally rectangular cross sectional shape of the bag.

20. A container as set forth in claim 19 wherein the conical wall and rim of the collar are formed with inwardly extending corrugations at locations in general vertical alignment with the locations at which said tensions members are secured to the bag side walls.

* * * * *